US005519902A

United States Patent [19]

Meade

[11] Patent Number: 5,519,902

[45] Date of Patent: May 28, 1996

[54] CONVERTIBLE FURNITURE FRAME WITH SELF-POSITIONING AND LOCKING LEGS

[76] Inventor: Thomas L. Meade, 274 Reese Rd., Nittany Mountain Industrial Park, State College, Pa. 16801

[21] Appl. No.: 366,855

[22] Filed: Dec. 30, 1994

[51] Int. Cl.[6] ..... A47C 17/17

[52] U.S. Cl. ..... 5/38; 5/42.1; 5/47; 297/354.13

[58] Field of Search ..... 5/37.1, 38, 41, 5/42.1, 42, 47, 48; 297/354.13

[56] References Cited

U.S. PATENT DOCUMENTS

| | | | |
|---|---|---|---|
| 2,730,727 | 1/1956 | Schneller | 5/38 |
| 2,784,766 | 3/1957 | Hale | 5/38 X |
| 3,002,198 | 10/1961 | Kaiser, Jr. | 5/41 |
| 3,867,730 | 2/1975 | Wright | 5/38 X |
| 4,696,069 | 9/1987 | Crosthwaite | 5/37.1 |
| 4,939,802 | 7/1990 | Lafer | 5/41 X |
| 5,083,333 | 1/1992 | Newton | 5/37.1 |
| 5,153,952 | 10/1992 | Barton et al. | 5/37.1 X |
| 5,327,591 | 7/1994 | Fireman et al. | 5/38 X |

*Primary Examiner*—Michael F. Trettel
*Attorney, Agent, or Firm*—Caesar, Rivise, Bernstein, Cohen & Pokotilow, Ltd.

[57] ABSTRACT

A furniture frame convertible from a first orientation to at least a second orientation includes two sections pivotally connected together and being movable relative to each other to permit the frame to be moved between the first and second orientations. One of the two sections includes a frame member having one end overlapping an end of a frame member of the other of the two sections and a pivot pin interconnects the overlapping ends for providing the pivotal connection between the two sections. A leg member has an upper end positioned between the overlapping ends of the frame members and the pivot pin connects the upper end of the leg member to the overlapping ends of the frame members for permitting pivotal movement of the leg member relative to each of the frame members. A locking and positioning system limits angular movement of the leg member relative to the frame members and locks the leg member against movement relative to the frame members when the leg member is providing a frame-supporting function.

10 Claims, 4 Drawing Sheets

FIG. 6
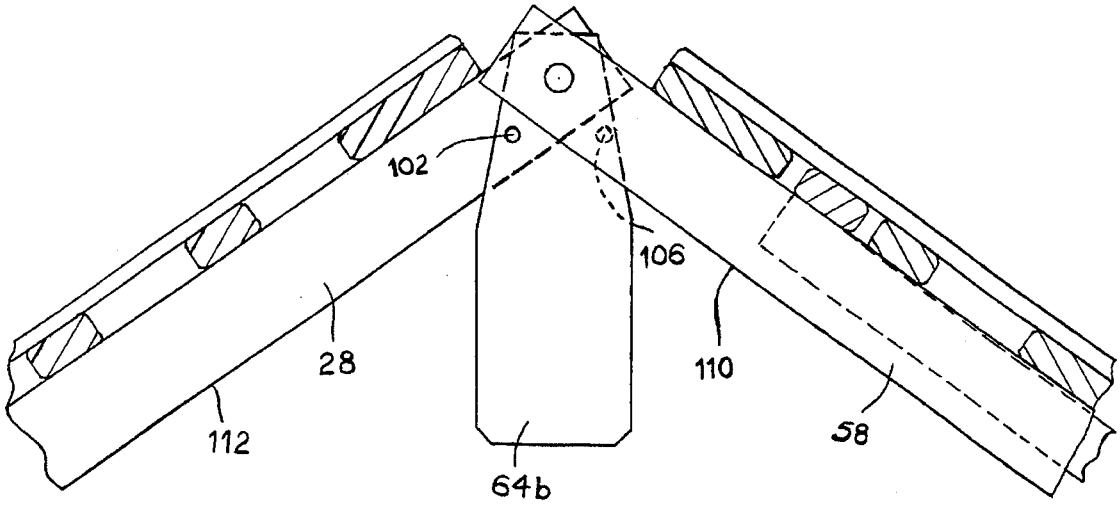
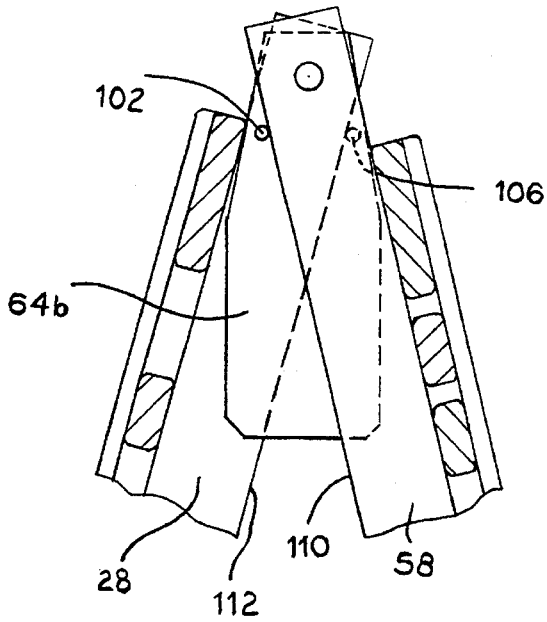
FIG. 7
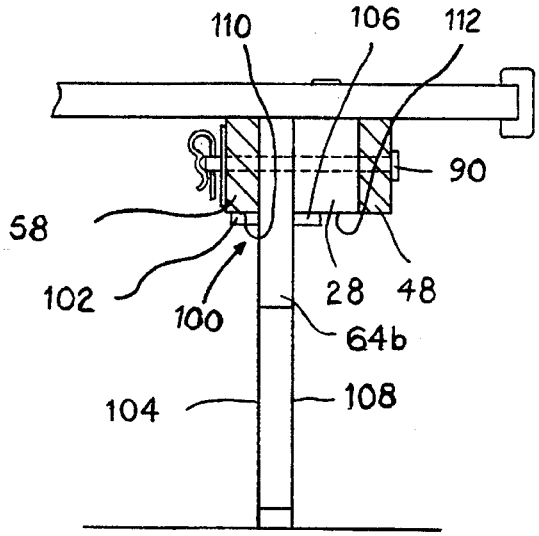
FIG. 8

CONVERTIBLE FURNITURE FRAME WITH SELF-POSITIONING AND LOCKING LEGS

FIELD OF THE INVENTION

This invention relates generally to convertible furniture frames, and more specifically to convertible frames of the tri-fold type, which are ideally suited for use in supporting futons in different body-supporting orientations.

BACKGROUND ART

Tri-fold frame constructions are well known in the prior art, and actually have been the standard construction in the industry for years. Although a variety of different mechanisms are employed to permit these tri-fold constructions to be oriented into different positions, the operating mechanisms often are difficult to use, and in many cases can actually damage the floor or other supporting surface when being opened from a seating piece orientation to a bed frame orientation.

One of the major disadvantages of prior art tri-fold constructions is the difficulty of converting the frame from a bed to a couch. First, the futon (which functions as the mattress of the bed) must be folded in half to expose the back or rear portion of the frame. Thereafter, the exposed frame section must be raised and locked, and then the entire frame, with the futon on it, must be slid back to the original position, usually against a wall. This is not an easy task, in view of the fact that the combined frame and futon weighs on the order of 100–140 pounds. Thus, what is intended to otherwise be a versatile piece of furniture, in actuality is difficult to use, and therefore unappealing. In fact, these prior art constructions may be impossible to operate by many individuals, such as individuals of small stature, individuals having little strength, or individuals that are elderly and/or handicapped.

Another disadvantage of some prior art tri-fold constructions becomes apparent when converting the frame from a "couch" or "chair" position, to a bed configuration. In order to accomplish this conversion the seat section generally is pulled out first, to thereby cause all three sections to pivot relative to each other. However, at some point the combined weight of the frame and futon overcomes the frictional resistance to sliding movement of the back section, resulting in both the middle and back sections collapsing to the floor. This often provides a very loud and disturbing noise, particularly in situations where the floor is not carpeted, which is often the case in studio apartments, dormitories and temporary housing in which the use of futon frames is becoming quite popular.

In applicant's earlier invention, as described and claimed in U.S. Pat. No. 5,170,519, the above-described problems associated with tri-fold frame constructions were solved, and the mechanisms employed in the '519 construction for solving such problems also are employed in the invention described herein. The subject matter of the '519 patent is fully incorporated herein by reference.

In a tri-fold construction constituting a modification of that disclosed in the '519 patent a number of pairs of discrete legs are provided to support the frame on the floor or other supporting surface. One pair of such legs is located at the junction of the rear and intermediate sections of the frame, and each leg of this pair is required to be movable relative to the frame-support member to which it is secured in order to permit these latter frame sections to be properly moved between the "couch" and "bed" orientations of the frame construction. Moreover, in the bed orientation the movable legs must be positioned in a proper orientation to support the frame member on the ground or other supporting surface, and also need to be "locked" in that proper orientation to preclude the legs from wobbling or collapsing either in use or when the opened frame construction (i.e., the bed orientation) is moved along its supporting surface.

In one prior art arrangement, flexible straps are connected to slats of intermediate and rear frame members of the tri-fold unit, and also to the movable legs located at the junction of such frame members. The lengths of the straps are such that the straps are intended to be maintained in a taught condition when the frame construction is in a fully opened orientation (i.e., in the bed orientation) to preclude undesired pivotal movement of the legs.

The above-described prior art strap arrangement has at least two major drawbacks. First, the straps need to be physically secured to both the intermediate and rear frame members and to the legs at the point of manufacture, thereby increasing the complexity (and cost) of the manufacturing operation. Second, in the event that one or more of the interconnecting straps either breaks in use or becomes separated from the pivotal leg, the frame could collapse and thereby become damaged. Moreover, home repair of the broken or separated strap can be deficult for the average person.

Thus, the need exists for a simplified and reliable mechanism or system for overcoming the above-described deficiencies of the prior art construction employing straps. The present invention relates to just such a system.

OBJECTS OF THE INVENTION

It is a general object of this invention to provide convertible furniture frames which are simple in construction, easy to use and reliable in operation.

It is a further object of this invention to provide convertible furniture frames which have an uncomplicated mechanism for positioning and locking movable legs associated therewith.

It is a further object of this invention to provide convertible furniture frame constructions which are well suited for use in supporting futons in different orientations and which employ a simple and reliable self-positioning and locking mechanism for pivotal legs associated with such constructions.

It is still a further object of this invention to provide a convertible tri-fold frame construction for supporting a futon in multiple orientations, and which is simple in construction, reliable in operation and easy to use.

It is a further object of this invention to provide convertible furniture frame constructions of the tri-fold type, which are ideally suited for use in supporting futons in multiple orientations and which employ a simple and reliable self-positioning and locking mechanism for pivotal legs associated with such frames.

It is a further object of this invention to provide a convertible furniture frame construction of the tri-fold type that can easily be manipulated between different orientations and which employs a simple and reliable self-positioning and locking mechanism for pivotal legs associated with such frame construction.

SUMMARY OF THE INVENTION

The above and other objects of this invention are achieved in a convertible furniture frame construction which is movable from a first orientation to a least a second orientation. In a preferred form of the invention the frame construction is a tri-fold construction for a futon and includes three interconnected sections.

In accordance with the broad aspects of the present invention the furniture frame includes two sections pivotally connected together and being movable relative to each other to permit the frame to be moved between the first and second orientations. One of the two sections includes a frame member having one end overlapping an end of a frame member of the other of said two sections. Pivot means interconnects the overlapping ends for providing the pivotal connection between the two sections. A leg member has an upper end that is positioned between the overlapping ends of the frame members and this leg member is pivotally connected to the overlapping ends of the frame members by the pivot means that connects the overlapping ends of the frame members together to thereby permit pivotal movement of the leg member relative to each of the frame members. Locking and positioning means is associated with said leg member for limiting angular movement of said leg member relative to the frame members to which the leg member is attached and for locking said leg member against movement relative to said frame members when the furniture frame is in said second orientation and said leg member is providing a frame supporting function. The locking and positioning means includes a pair of stop members, one of said pair of stop members overlying a surface of the frame member of said one section and the other of said pair of stop members overlying a surface of the frame member of the other of said sections, said pair of stop members being positioned on said leg member so as to be closely adjacent the overlying surfaces of the frame members when the frame is in said second orientation and the leg member is oriented to support the frame on the ground or other supporting surface.

In the preferred form of the invention the pair of stop members overly the surfaces of the frame members in a location in which the ends of the frame members overlap each other.

Most preferably each stop member of said pair of stop members is a member projecting transversely of said leg member from a respective side of said leg member. Most preferably each stop member is in the form of pin-like member having one end connected to the leg member and an opposite end overlying a frame member of the first and second sections, respectively.

In the most preferred embodiment of the invention the pivot means is an elongate pin extending through openings in the overlapping ends of the frame members of the two sections and through an opening in the upper end of the leg member located between said overlapping ends.

In the preferred embodiment of this invention the two sections of the frame are disposed substantially in the same plane when the frame is in the second orientation and are disposed at an acute angle to each other when the frame is in the first orientation. Most preferably the pivot means is connected to the overlapping ends of the frames of the two sections in a location for allowing the frame member of one of said two sections to be positioned substantially normal to the ground or other supporting surface when the frame is in the first orientation.

In the preferred embodiment of the invention the stop members are positioned relative to the frame members of the two sections such that when the frame is in the first orientation one of said pair of stop members overlies and is closely adjacent to an edge of a frame member of one of said sections and the other of said pair of stop members overlies and is closely adjacent to an edge of a frame member of the other of said sections. Most preferably the edges of the frame members of the two sections in the locations in which the stop members overly said edges are on opposite sides of the pivot means when the frame is in said first orientation.

In the most preferred embodiment of the invention the furniture frame is a tri-fold construction including a third section in addition to the above-described two sections. The above-described two sections constitute a rear section and an intermediate section of the tri-fold construction, and the third section constitutes a front section of the tri-fold construction. Most preferably each of the three sections includes a forward end, a rearward end, and transversely spaced-apart side edges, with the rearward end of the front section being pivotally secured to the forward end of the intermediate section and the rearward end of the intermediate section being pivotally secured to the forward end of the rear section.

In the most preferred embodiment of the tri-fold construction a first pair of transversely spaced-apart leg members is secured adjacent the forward end of the front section, a second pair of transversely spaced-apart leg members is secured adjacent the pivotal connection between the front section and the intermediate section, a third pair of transversely spaced-apart leg members is pivotally secured at the pivotal connection between the rearward end of the intermediate section and the forward end of the rear section, and a fourth pair of transversely spaced-apart leg members is secured adjacent the rearward end of the rear section. Most preferably the leg members of the fourth pair of transversely spaced-apart leg members are located to engage frame members of the fron section when the frame is in the first orientation to form a seating piece in which the intermediate section constitutes the backrest.

BRIEF DESCRIPTION OF THE DRAWINGS

Other objects and many of the attendant advantages of this invention will be readily appreciated as the same becomes better understood by reference to the following detailed description when considered in connection with the accompanying drawings wherein:

FIG. 6 is an enlarged, fragmentary sectional view of the rear frame section, the intermediate frame section, and the leg member pivotally connected to the rear and intermediate frame sections when the frame construction is in an intermediate position between the first seating piece orientation in which the intermediate section constitutes the backrest and the second orientation in which the frame construction either is employed as a bed frame or as a chaise lounge;

FIG. 7 is an enlarged, fragmentary sectional view similar to FIG. 6, but showing the positional arrangement of the rear frame section, the intermediate frame section, and the leg member pivotally connected to the rear and intermediate frame sections when the frame is in a more retracted orientation than that shown in FIG. 6;

FIG. 8 is a fragmentary section view taken along line 8—8 of FIG. 3.

DESCRIPTION OF THE PREFERRED EMBODIMENTS OF THE INVENTION

Figure 1:
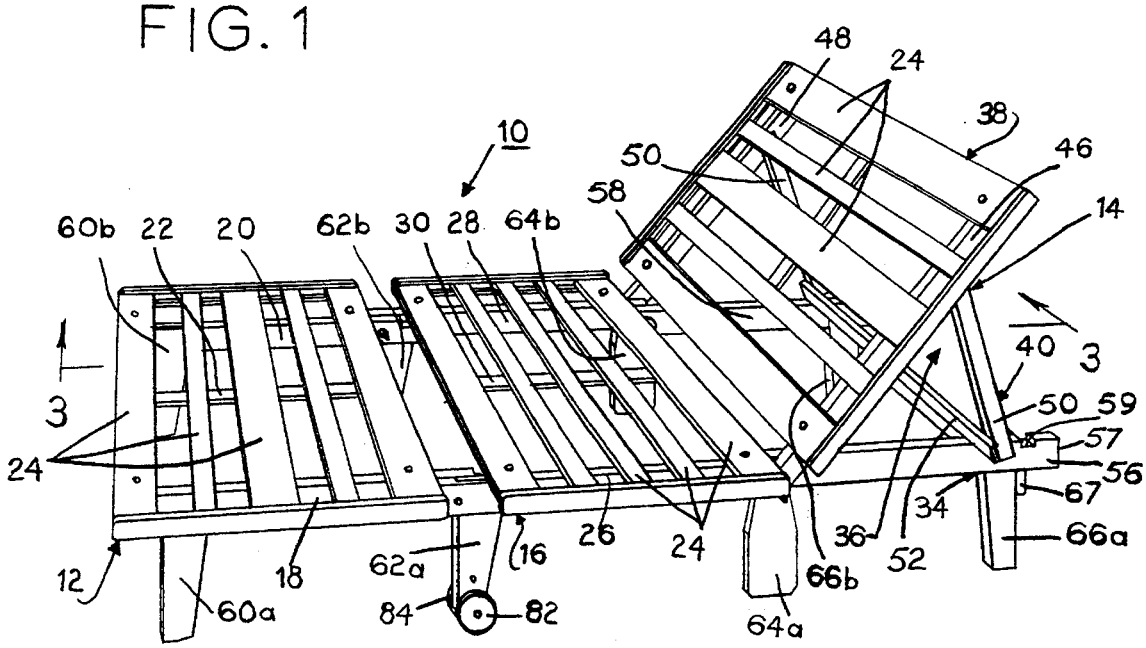
FIG. 1 is an isometric view of a convertible furniture frame in accordance with this invention with the frame oriented into a configuration of a chaise lounge having a movable back-supporting member of the rear frame section in a raised position to support the back of a person.

Referring now in greater detail to the various figures of the drawings wherein like reference characters refer to like parts, a convertible furniture frame embodying the present invention is generally shown at 10 in FIG. 1. The convertible frame 10 generally includes a front section 12, a rear section 14, and an intermediate section 16, all of which are pivotally secured together in a manner to be described in detail hereinafter.

Referring to FIG. 1, the front section 12 of the frame 10 includes transversely spaced-apart side frame members 18 and 20, an intermediate frame member 22 between said side frame members, and transversely extending slats 24 secured to said side and intermediate frame members for supporting a futon or other body-supporting member thereon.

Still referring to FIG. 1, the intermediate section 16 includes transversely spaced-apart side frame members 26 and 28, an intermediate frame member 30 between said side frame members, and transversely extending slats 24 secured to said side and intermediate frame members for supporting a futon or other body-supporting member thereon.

Figure 5:
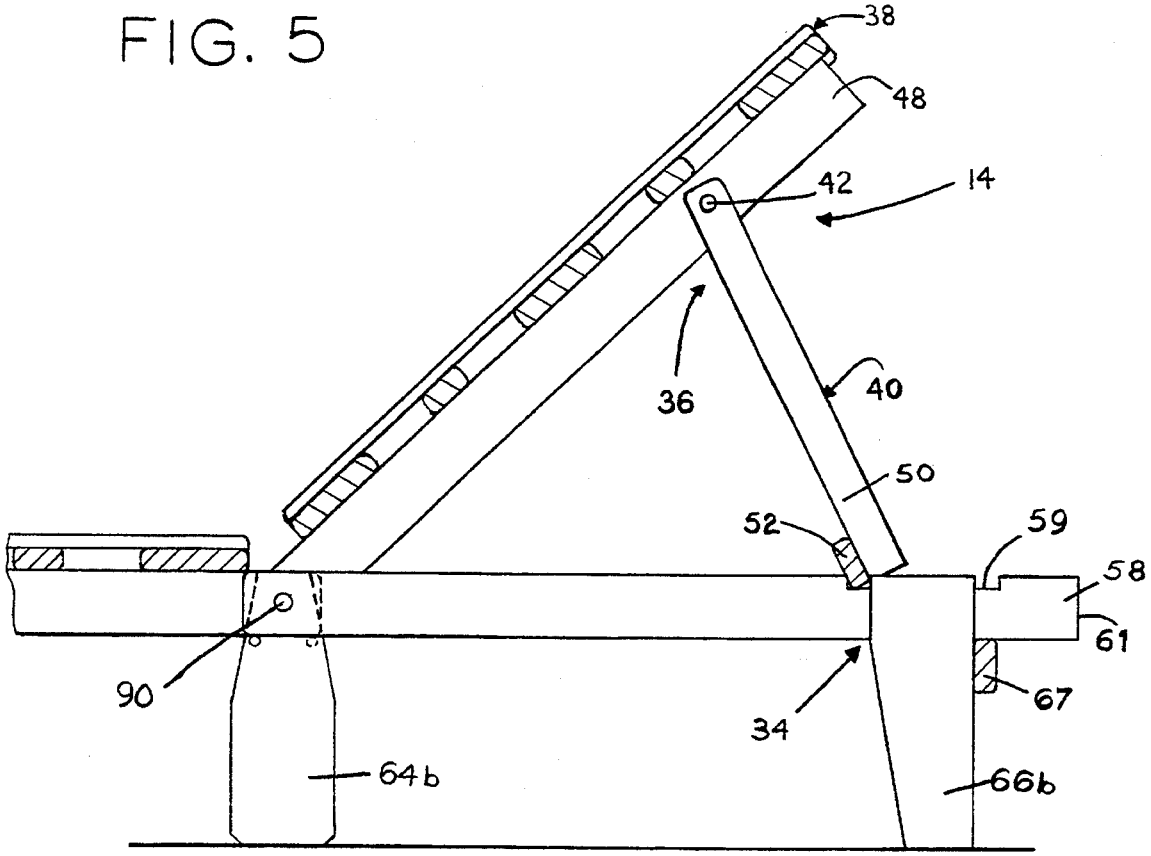
FIG. 5 is an enlarged, fragmentary sectional view showing the rear portion of the seating piece illustrated in FIG. 1.

Referring to FIGS. 1 and 5, the rear section 14 includes a lower support section 34 and an upper backrest section 36 mounted for pivotal movement to said lower support section. The backrest section includes a back supporting panel 38 and a swing arm 40. The back supporting panel 38 includes transversely spaced-apart supporting side frames 46 and 48 to which the swing arm 40 is attached and to which transversely extending slats 24 are secured. These slats constitute a support for a futon or other body supporting member thereon.

Referring to FIGS. 1 and 5, the swing arm 40 of the back rest section 36 includes swing arm uprights 50 and a cross bar 52 joined to the uprights. The uprights are pivotally connected to the side frames 46 and 48 through pivot pins 42 (only one of which is shown in FIG. 5).

Still referring to FIGS. 1 and 5, the lower support section 34 includes transversely spaced-apart side frame members 56 and 58 having U-shaped slots 59 formed in upper surfaces thereof with the slots being transversely aligned to receive the cross bar 52 of the swing arm 40 therein to thereby adjust the angle of inclination of the back supporting panel 38 relative to the upper surface of the slats 24 of the intermediate panel 16. In the preferred embodiment of this invention there are two such sets of U-shaped slots 59 spaced longitudinally along the upper surfaces of the side frame members 56 and 58 to permit the back supporting panel 38 to be adjusted into two different back-supporting positions relative to the upper surface of the intermediate panel 16, in addition to the collapsed condition shown in FIG. 3. In the collapsed condition, the swing arm 40 is rotated clockwise, as viewed in FIGS. 1 and 5, into a position within the confines of the side frame members 46 and 48 of the back supporting panel 38.

Referring specifically to FIG. 1, the frame 10 is provided with four pairs of legs 60, 62, 64, and 66. Legs **60*a*, 60*b* of a first pair of legs 60 are transversely spaced apart from each other and are stapled and glued to the side frame members 18 and 20, respectively, of the front section 12. Legs 62*a*, 62*b* of a second pair of legs 62 are transversely spaced apart from each other and are stapled and glued to the side frame members 26 and 28 of the intermediate section 16. Legs 64*a*, 64*b* of a third pair of legs 64 are transversely spaced apart from each other and are secured to cooperating frame members by a unique arrangement of this invention, to be described in detail hereinafter. Legs 66*a*, 66*b* of a fourth pair of legs 66 are stapled and glued to side frame members 56, 58 of the lower support section 34 of rear section 14. The lower support section 34 is further stablized by the attachment of a transversely extending brace member 67 to the transversely spaced-apart legs 66*a*, 66*b* of the fourth pair of legs 66**.

Figure 3:
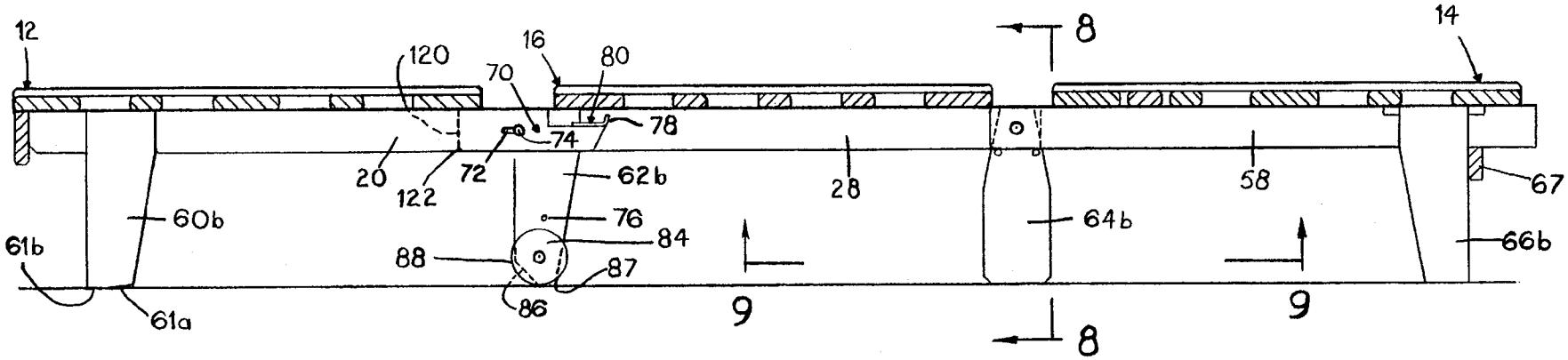
FIGS. 3 is a sectional view taken along line 3—3 of FIG. 1 but with the movable back-supporting member of the rear frame section collapsed to permit the frame to be utilized as a bed frame.
Figure 4:
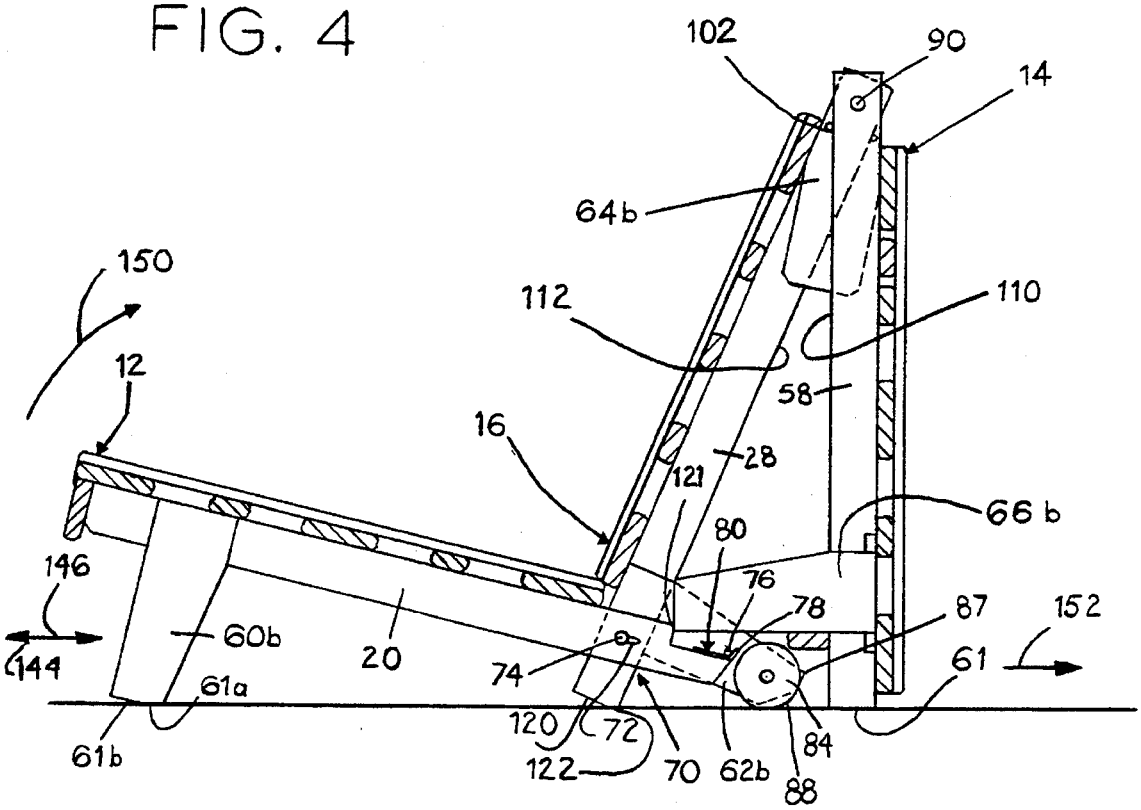
FIG. 4 is a sectional view taken along line 3—3 of FIG. 1, but with the frame construction in a first orientation in the form of a seating piece employing the intermediate section as the backrest.

Referring to FIGS. 3 and 4, the front section 12 is pivotally secured to the intermediate section 16 through a hinge and stop arrangement 70 that is substantially similar to the hinge and stop arrangement 50 of the convertible furniture frames described in applicant's earlier '519 patent, the subject matter of which already has been incorporated herein by reference.

The hinge and stop arrangement 70 is provided to positively maintain or lock the sections 12 or 16 at approximately a 100 degree angle relative to each other (with the angle being tilted approximately 23 degrees clockwise from the horizontal plane, as viewed in FIG. 4) to form a seating piece frame (e.g., loveseat, couch or chair) as is shown in FIG. 4, and which can easily be manipulated to permit relative movement between the sections 12 and 16 to form a chaise lounge frame, as shown in FIG. 1, or a bed frame, as is shown in FIG.

Referring to FIGS. 3 and 4, the cooperative elements of the hinge and stop mechanism 70 associated with adjacent side frame members 20 and 28 of sections 12 and 16, respectively, will be described. It should be understood that this same hinge and stop mechanism also is associated with the adjacent side frame members 18 and 26.

Still referring to FIGS. 3 and 4, the hinge and stop mechanism 70 includes an elongate slot 72 provided in side frame member 20 of section 12, and into which a hinge pin 74 extends. This hinge pin 74 is secured within an opening (not shown) in the side frame member 28 of section 16, and cooperates with the slot 72 to provide a hinge connection about which the sections 12 and 16 are rotatable relative to each other.

Still referring to FIG. 3 and 4, the slot 72 is elongated, having its long dimension aligned in a direction from the forward edge to the back edge of the side frame member 20, and being essentially parallel to the top surface of said side frame member. When the sections 12 and 16 are maintained in the orientation of the seating piece shown in FIGS. 4, the hinge pin 74 extends into the elongate slot 72 adjacent the left or forward end of the slot, as viewed in FIG. 4.

As will be explained in greater detail hereinafter, and as is explained fully in the aforementioned '519 patent, the provision of an elongate slot 72 for cooperating with the hinge pin 74 permits the desired locking of the sections 12 and 16 in the orientation illustrated in FIGS. 4, while at the same time permitting easy release of the locking arrangement, to permit the sections 12 and 16 to assume the configuration shown in FIGS. 1 and 3, in which the frame 10 functions either as a chaise lounge frame or as a bed frame for a futon or other mattress-type member, respectively.

Referring to FIGS. 3 and 4, the locking arrangement provided by the hinge and stop mechanism 70, in the preferred embodiment, includes a stop pin 76 retained within an opening (not shown) in leg **62*b*, which is secured to the side frame 28 of intermediate section 16. That pin 76 extends transversely from the leg 62*b* into engagement with an upstanding lip 78 of a metal stop plate 80. The metal stop plate 80 is secured to the upper surface of side frame member 20** in a relieved area adjacent the rear of said side frame member by screws, adhesive, or other suitable fastening means.

It should be understood that the cooperative arrangement between the elongate slot 72 and the hinge pin 74, as well as the cooperative arrangement between the stop pin 76 and the upstanding lip 78 of the stop plate 80, as described above, also is provided between the adjacent sections of side frame member 18 of section 12 and side frame member 26 of intermediate section 16. Since the construction of the hinge and stop mechanism 70 is identical at this latter location, no further description is necessary to provide a teaching that is understandable to a person skilled in the art.

Referring to FIGS. 3 and 4, it should be noted that the lower surface 61 of each of the legs **60*a*, 60*b* of the first pair of legs 60 has a rear planar segment 61*a* and a forward planar segment 61*b* lying in different planes. The rear planar segment 61*a* is oriented to rest on the floor or other supporting surface when the frame 10 is in a collapsed orientation to form a chair or couch frame as shown in FIG. 4, and the forward planar segment 61*b* is oriented to rest on the floor or other supporting surface when the frame 10 is in its fully opened condition to form a bed frame or chaise lounge frame as shown in FIG. 3**.

Referring to FIGS. 1, 3 and 4, each of the legs **62*a*, 62*b* of the pair of legs 62 includes a pair of wheels 82, 84 rotatably mounted adjacent a lower end thereof. The lower end of each of the legs 62*a*, 62*b* is relieved at 86 to expose the periphery 88 of the wheels so that the periphery will be in rolling engagement with the ground or other supporting surface in a manner to be described in detail hereinafter. As will be noted in FIG. 3, a rear, unrelieved lower segment 87 of the legs 62, 62*b* engages the ground or other supporting surface and constitutes the load bearing surface when the front section 12 and intermediate section 16 are fully opened to form the chaise lounge frame of FIG. 1 or the bed frame of FIG. 3. In this latter orientation the wheels 82, 84** may also engage the ground but without any significant load being imposed upon them.

Figure 2:
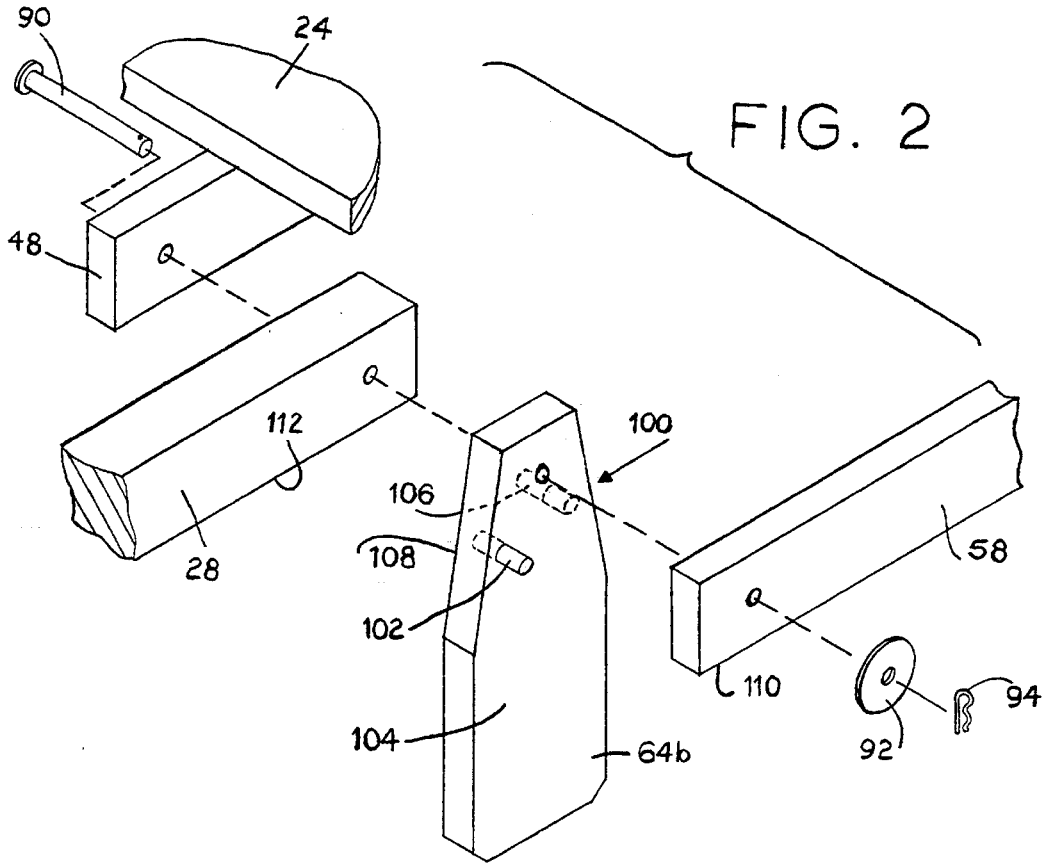
FIG. 2 is an exploded isometric view showing the arrangement employed for pivotally attaching the leg members to overlapping ends of frame members of the intermediate and rear sections of the tri-fold furniture frame of this invention.
Figure 9:
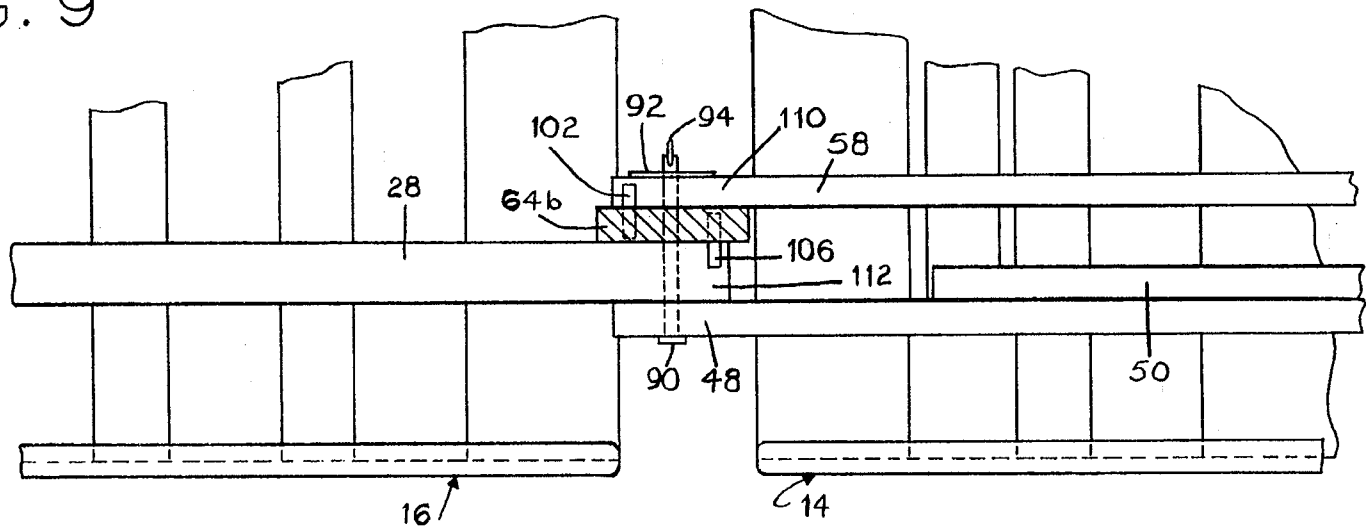
FIG. 9 is a sectional view taken along line 9—9 of FIG. 3.

Referring to FIGS. 2, 8 and 9, a unique arrangement for positioning and locking bell legs **64*a*, 64*b* in the frame 10 will be described in detail. An elongate pivot pin 90 extends, in seriatim, through aligned openings in supporting side frame 48 of the back supporting panel 38 of rear section 14, side frame member 28 of the intermediate panel 16, bell leg 64*b*, and side frame member 58 of the lower support section 34 of the rear section 14. A washer 92 and conventional clip 94** are employed to retain the pivot pin within the aligned openings to thereby provide a rotatable interconnection of the various members through which the pivot pin passes.

Still referring to FIGS. 2, 8 and 9, a unique locking and positioning means 100 in accordance with the preferred embodiment of this invention includes stop members in the form of an elongate pin 102 extending transversely outwardly from sidewall 104 of the leg **64*b* and an elongate pin 106 extending transversely outwardly from opposed sidewall 108 of the leg 64*b*. The pin 102 extends into a position overlying side edge or surface 110 of the side frame member 58 of the rear section 14, and the pin 106 extends into a position overlying side edge or surface 112 of the side frame member 28 of the intermediate section 16. Most preferably the pins 102 and 106 are positioned to actually engage the surfaces 110 and 112, respectively, when the frame 10 is in its fully extended position to form the chaise lounge frame shown in FIG. 1, or the bed frame shown in FIG. 3. As should be noted the pins 102 and 106 are transversely located on opposite sides of the pivot pin 90. Thus, by engaging the surfaces 110 and 112 of the side frame members 58 and 28, respectively, with the pins 102 and 106, respectively, the leg 64*b* is "locked" in its ground supporting orientation, and will not pivot or rotate out of that position when the frame 10** is being moved.

It should be understood that the above-described positioning and locking arrangement also is provided in connection with bell leg **64*a*, and therefore additional discussion of this arrangement in connection with the bell leg 6*ab*** is not required to provide a full and complete disclosure of this invention.

Reference throughout this application including the claims to a stop means or pin being "closely adjacent" to a surface or edge of a frame member is intended to include both a contacting and a non-contacting relationship between the stop means or pin and that surface or edge. However, the non-contacting relationship must still provide the required locking and/or positioning functions.

It should be understood that although the stop means in the preferred embodiment of the invention includes elongate pins, the stop means can be any member providing a surface extending transversely outwardly from sidewalls 104 and 108 a sufficient distance to extend into a position overlying side edge or surface 110 of the side frame member 58 of the rear section 14, and side edge or surface 112 of the side frame member 28 of the intermediate section 16, respectively.

Referring to FIG. 4, when the frame 10 is in its fully retracted position to form a seating piece wherein the intermediate section 16 constitutes the backrest, the elongate pins 102 and 104 extending from the leg **64*b* engage edges 110 and 112 of the side frame members 58 and 28, respectively, to assist in maintaining the leg 66*b*** in an immobilized, generally vertical orientation.

Moreover, as can be seen best in FIG. 6, even when the side frame members 58 and 28 are in a position intermediate their fully opened position (FIGS. 1 and 3) and their fully retracted position (FIGS. 4 and 7), wherein the pins 102 and 106 in the leg **64*b* do not engage the edges 110 and 112 of said side frame members, the overlying relationship between the pins and side frame members limits the permitted pivotal movement of the leg 64*b* (and also leg 64*a***).

Referring to FIG. 7, as the side frame members 58 and 28 are moved into a more fully retracted position than that illustrated in FIG. 6 the edges 110 and 112 of the side frame members engage the pins 102 and 106 attached to the leg **64*b* and thereby control the orientation of the leg as the side frame members are moved into the fully retracted position shown in FIG. 4**.

Moreover, as can be seen best in FIG. 4, in accordance with the preferred embodiment of this invention the pivot pin 90 is located to permit the side frame members 56 and 58 of the lower support section 34 to be positioned substantially normal to the ground or other supporting surface when the frame is in its fully retracted position. In this position the entire surface of each of the planar distal edges 57, 61 of the side frame members 56, 58 remote from the pivot pin 90 is disposed in contact with the ground or other supporting surface for the frame 10.

Still referring to FIG. 4, in the fully retracted position of the frame 10 a distal edge 121 of the rear leg **66*b* engages an aligned side frame member 20 of the front section 12. In a like manner, but not shown in the drawings, the distal edge of the rear leg 66*a* engages an aligned side frame member 18 of the front section 12. This further stabilizes the structure when it is in its retracted position to provide a seating piece in which the intermediate section 16** constitutes the backrest.

Referring to FIGS. 3 and 4, forward edges of the side frame members 26, 28 (only forward edge 120 of side frame member 28 being shown in the Figures) have a relieved planar segment 122 which is oriented to lie flat on the ground or other supporting surface when the frame 10 is in its fully retracted position as is shown in FIG. 4. Although the peripheries 88 of the wheels 82, 84 engage the ground or other supporting surface in the fully retracted position of the frame 10, these wheels do not provide the load bearing function for the seating piece. Rather, the load bearing function is provided by the engagement of the ground or other supporting surface by the surfaces 122 and 61 of the triangularly oriented frame members 28 and 58, respectively. In a like manner, the triangularly oirented frame members 26 and 56 also provide a load bearing function.

The convertible furniture frame 10 of this invention is converted from the fully retracted seating piece orientation shown in FIG. 4 to a fully extended chaise lounge or bed orientation as shown in FIGS. 1 and 3, respectively, in the same manner that the tri-fold convertible furniture frame 10A described in the '519 patent is converted from the seating piece orientation illustrated in FIG. 8 of that patent to the bed frame orientation shown in FIG. 12. Although the entire disclosure of the '519 patent has been incorporated herein by reference, a brief discussion of the manner in which the convertible furniture frame of this invention is converted from a fully retracted seating piece orientation to a fully extended chaise lounge or bed orientation will be described.

As explained in the '519 patent, the conversion from the fully retracted to the fully extended orientation can be accomplished completely from the front of the seating piece, preferably by a person gripping the forward end of the front section 12. First, the user merely pulls the front of forward section 12 in an outward direction, as indicated by arrow head 144 of double-headed arrow 146 in FIG. 4. Due to the fact that the front section 12 and the intermediate section 16 are locked in the relative position occupied in the seating piece orientation shown in FIG. 4, as a result of the interconnection of elements by the hinge and stop mechanism 70, the outward motion of the front section 12 forces the forward end of the front section and the end of the intermediate section 16 attached to the front section in an upward, generally clockwise direction, in the same manner as is shown in FIG. 9 of the '519 patent. This causes the periphery 88 of the wheels 82, 84 secured to the legs **62*a*, 62*b* to rollingly engage the floor or other supporting surface. This occurs because the load bearing edge 122 of the side frame member 28 and the corresponding load bearing edge (not shown) of the side frame member 26 of the intermediate section 16 are lifted off of the ground or other frame-supporting surface. At this point the frame is touching the floor at two places; namely, along a line provided by the periphery 88 of each of the wheels 82, 84, and along a line provided by the leading edge of the planar surfaces 57, 61 of the side frame members 56, 58, respectively, of the rear section 14, in the same manner as the leading edge 148 of the rear surface 122 of each of the side frame members 120 engages the ground in the tri-fold frame 10A shown and described in the '519 patent (see FIG. 9 of the '519 patent). The engagement of the leading edge of the planar surfaces 57, 61 of each of the side frame members 56, 58 with the ground or other supporting surface is a relatively high friction engagement, as compared to the engagement provided between the supporting surface and the periphery 88 of the rotatable wheels 82, 84. Thus, in this orientation continuous movement in the direction of arrowhead 144 (see FIG. 4) initially causes the sections 12, 14 and 16 to open up and/or extend very easily, and most importantly, the downward descent of the hinged rear section 14 and the intermediate section 16 is positively controlled by the rotation of the forward or front (i.e., seat) section 12, in the direction of the arrow 150 illustrated in FIG. 4 (which is the same as the direction of the arrow 150 illustrated in FIG. 10 of the '519 patent). This controlled movement is achieved because the front section 12 remains locked against relative movement to the intermediate section 16, thereby providing for the controlled descent of both the intermediate section 16 and the rear section 14** hinged thereto.

When the rear section 14 and intermediate section 16 initially reach a substantial horizontal orientation as is shown in FIGS. 1 and 3, the front section 12 will be in a position approximately 10 degrees to the left of vertical (e.g., see FIG. 11 of the '519 patent). Thereafter, further rotational movement of the front section 12 in a clockwise direction, as is shown by the direction of arrow 150 in FIG. 4 (and arrow 154 in FIG. 11 of the '519 patent), positions the outer surfaces of slats 24 of the front section 12 into a substantial vertical orientation, with the lip 78 of the stop plate 80 being moved out of underlying relationship with the stop pin 76. Thereafter, the front section 12 is lifted upwardly in a general vertical direction to move the lip 78 of the stop plate 80 above the stop pin 76. This movement is permitted by the elongate slot 72. In this latter position the front section 12 can be rotated in a counterclockwise direction to move the front section 12 into the generally horizontal position shown in FIGS. 1 and 3, to thereby complete the conversion of the seating piece shown in FIG. 4 to either the chaise lounge or bed orientation shown in FIGS. 1 and 3, respectively.

It should be understood that the frame construction 10 can be reconverted from the bed orientation shown in FIG. 3 to the seating piece orientation shown in FIG. 4 from the forward edge of front section 12, by reversing the above-enumerated steps employed to convert the frame from the seating piece orientation shown in FIG. 4 to the bed frame or chaise lounge orientation or bed frame orientation shown in FIGS. 1 and 3, respectively.

Without further elaboration the foregoing will so fully illustrate my invention that others may, by applying current or future knowledge, adopt the same for use under various conditions of service.

I claim:

1. A furniture frame convertible from a first orientation to at least a second orientation, said frame including two sections pivotally connected together and being movable relative to each other to permit the frame to be moved between the first and second orientations, one of said two sections including a frame member having one end overlapping an end of a frame member of the other of said two sections and pivot means interconnecting said overlapping ends for providing the pivotal connection between the two sections, a leg member having an upper end positioned between the overlapping ends of the frame members and said pivot means connecting said upper end of the leg member to the overlapping ends of the frame members for permitting pivotal movement of the leg member relative to each of the frame members, locking and positioning means associated with said leg member for limiting angular movement of said leg member relative to the frame members and for locking said leg member against movement relative to said frame members when the furniture frame is in said second orientation and said leg member is providing a frame supporting function, said locking and positioning means including a pair of stop members, one of said pair of stop members overlying a surface of the frame member of said one section and the other of said pair of stop members overlying a surface of the frame member of the other of said sections, said pair of stop members being positioned on said leg member so as to be closely adjacent the overlying surfaces of the frame members when the frame is in said second orientation and the leg member is oriented to support the frame on the ground or other supporting surface.

2. The furniture frame of claim 1, wherein the pair of stop members overly the surfaces of the frame members in a location in which the ends of the frame members overlap each other.

3. The furniture frame of claim 1, wherein each stop member of said pair of stop members is a member projecting transversely of said leg member from a respective side of said leg member.

4. The furniture frame of claim 1, wherein each stop member is in the form of pin-like member having one end connected to the leg member and an opposite end overlying a frame member of the first and second sections, respectively.

5. The furniture frame of claim 1, wherein said pivot means is an elongate pin extending through openings in the overlapping ends of the frame members of the two sections and through an opening in the upper end of the leg member located between said overlapping ends.

6. The furniture frame of claim 1, wherein said two sections are disposed substantially in the same plane when the frame is in said second orientation and are disposed at an acute angle to each other when the frame is in said first orientation, said pivot means being connected to the overlapping ends of the frames of the two sections in a location for allowing the frame member of one of said two sections to be positioned substantially normal to the ground or other supporting surface when said two sections are in the first orientation.

7. The furniture frame of claim 6, wherein said stop members are positioned relative to the frame members of the two sections such that when the frame is in said first orientation one of said pair of stop members overlies and is closely adjacent to an edge of a frame member of one of said sections and the other of said pair of stop members overlies and is closely adjacent to an edge of a frame member of the other of said sections.

8. The furniture frame of claim 7, wherein the edge of the frame member of said one of said sections and the edge of the frame member of said other of said sections in the locations in which the stop members overly said edges are on opposite sides of the pivot means when the frame is in said first orientation.

9. The furniture frame of claim 1 in the form of a trifold construction including an additional section, said two sections being a rear section and an intermediate section and said additional section being a front section pivotally secured to the intermediate section.

10. The furniture frame of claim 9 wherein each of said sections includes a forward end, a rearward end, and transversely spaced-apart side edges, said rearward end of the front section being pivotally secured to the forward end of the intermediate section and the rearward end of the intermediate section being pivotally secured to the forward end of the rear section, a first pair of transversely spaced-apart leg members adjacent the forward end of the front section, a second pair of transversely spaced-apart leg members adjacent the pivotal connection between the front section and the intermediate section, a third pair of transversely spaced-apart leg members located at the pivotal connection between the rearward end of the intermediate section and the forward end of the rear section, and a fourth pair of transversely spaced-apart leg members located adjacent the rearward end of the rear section.

* * * * *